US006746386B1

(12) United States Patent
Huang

(10) Patent No.: US 6,746,386 B1
(45) Date of Patent: Jun. 8, 2004

(54) EXERCISER FOR ROWING AND STEPPING EXERCISES

(76) Inventor: Sherry Huang, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/339,973

(22) Filed: Jan. 9, 2003

(51) Int. Cl.[7] ..... A63B 26/00; A63B 71/00

(52) U.S. Cl. ..... 482/140; 72/907; 72/95; 72/96

(58) Field of Search ..... 482/140, 72, 907, 482/148, 95, 96

(56) References Cited

U.S. PATENT DOCUMENTS 5,630,778 A 5/1997 Barreca ..... 482/140
5,728,035 A 3/1998 Sands ..... 482/140
5,871,425 A * 2/1999 Gvoich ..... 482/140

* cited by examiner

*Primary Examiner*—Nicholas D. Lucchesi
*Assistant Examiner*—L Amerson
(74) *Attorney, Agent, or Firm*—Charles E. Baxley

(57) ABSTRACT

An exerciser includes a pair of frames each having a curved bottom surface for engaging with a supporting surface and for conducting swinging operations. A seat is secured between the frames for supporting a user and for elevating the user when the frames are swung relative to the supporting surface, against the weight of the users. A foot rest is resiliently coupled to the frames with one or more resilient members, for allowing users to move the foot rest away from the frames against the spring members, in order to exercise the lower muscle groups.

9 Claims, 3 Drawing Sheets

EXERCISER FOR ROWING AND STEPPING EXERCISES

BACKGROUND OF THE INVENTION

1. Field of the Invention

The present invention relates to an exerciser, and more particularly to a gravity exerciser for conducting rowing and stepping exercises.

2. Description of the Prior Art

Various kinds of typical exercisers have been developed for exercising abdominal portions of users, and comprise a pair of anchor plates disposed or supported on the supporting surface or ground, a pair of curved portions pivotally supported on the anchor plates, a head set attached to one end of the curved portions, and a handle attached to the other end of the curved portions of the exerciser. The typical exercisers further comprise a pair of arm rests for supporting arms of users.

For example, U.S. Pat. No. 5,630,778 to Barreca, and U.S. Pat. No. 5,728,035 to Sands disclose two of the typical exercisers, and may be used for exercising abdominal portions of users only.

In addition, the curved portions of the exercisers are pivotally supported on the anchor plates, and may not be rotatably or pivotally supported on the ground or the supporting surface, and thus may not swing relative to the ground or the supporting surface.

None of the typical exercisers may be used to support the weight of the user, and for allowing the user to swing and to elevate the body of the user with the exercisers.

The present invention has arisen to mitigate and/or obviate the afore-described disadvantages of the conventional exercisers.

SUMMARY OF THE INVENTION

The primary objective of the present invention is to provide an exerciser for conducting at least rowing and stepping exercises.

The other objective of the present invention is to provide an exerciser including a seat for supporting users, and for allowing users to elevate their own bodies whiling rowing the exerciser.

The further objective of the present invention is to provide an exerciser including a foot rest for supporting and/or for exercising foot portion of users.

In accordance with one aspect of the invention, there is provided a n exerciser comprising a pair of frames each including a curved bottom surface for engaging with a supporting surface, and for conducting swinging operations, and a seat secured between the frames for supporting a user thereon, the frames each includes a first end having a handle provided thereon for swinging the frames, to elevate the seat against the user. A foot rest is resiliently coupled to the frames with one or more resilient members, for allowing users to move the foot rest away from the frames against the spring members.

The seat includes a pivot rod secured between the frames, for pivotally securing the seat between the frames. The resilient member may be coupled between the foot rest and the pivot rod.

The frames each includes a second end having the curved bottom surface formed thereon, and each includes a middle portion having a flat surface formed thereon, for allowing the frames to be stably supported on the supporting surface.

The handles of the frames each includes a hand grip laterally extended outwardly therefrom for allowing the users to firmly grasp the handles.

The foot rest includes an upper portion having an inclined surface formed thereon to support feet of the user. The foot rest includes two sides each having a bracket provided thereon, the resilient members may be coupled between the sides of the bracket and the frames.

The brackets each includes an aperture formed therein, the resilient members may be engaged through the apertures of the brackets, and each includes an enlarged end anchored to the brackets respectively. The brackets each includes a slit formed therein and communicating with the aperture thereof for allowing the resilient members to be engaged through the apertures of the brackets.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
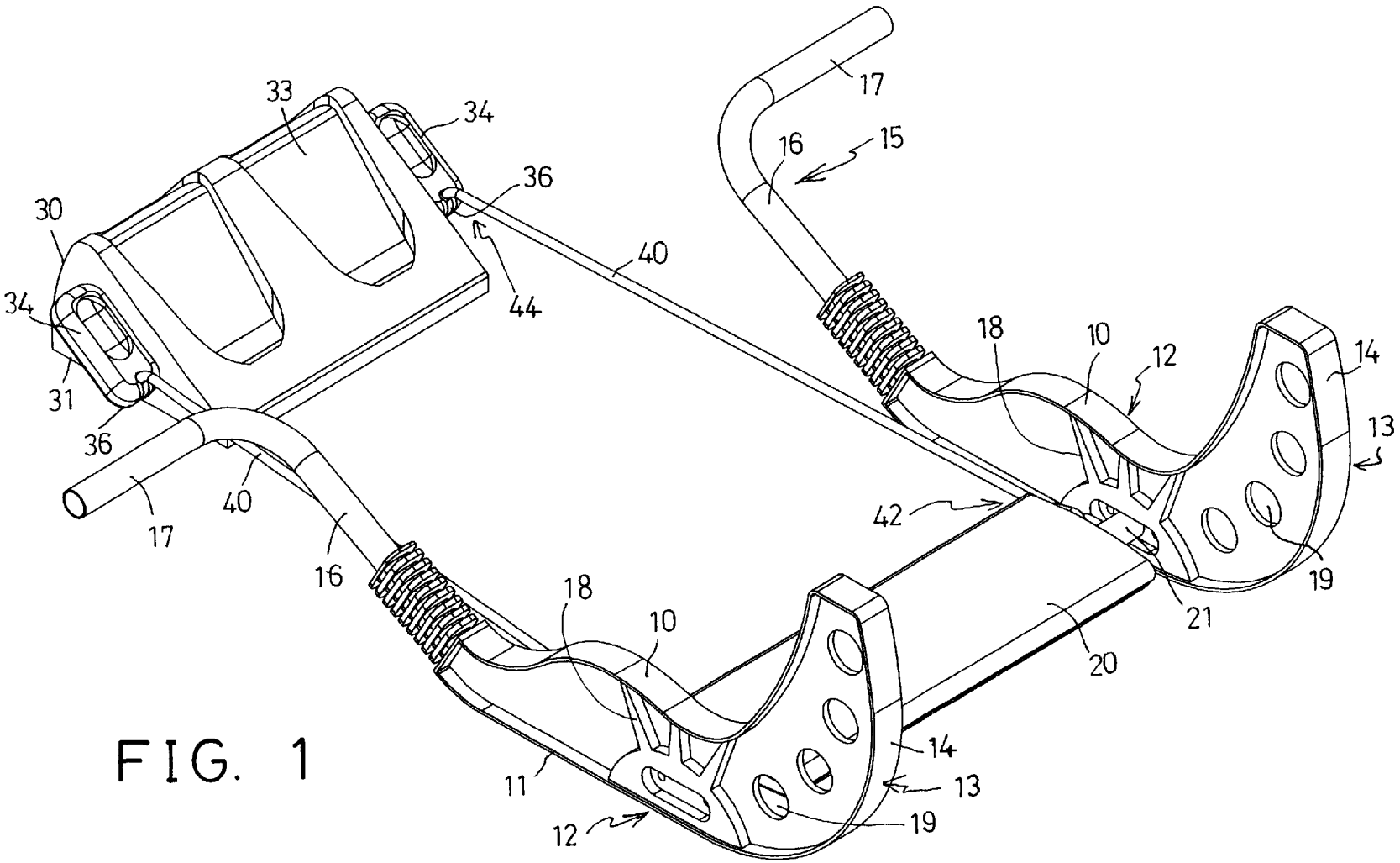
FIG. 1 is a perspective view of an exerciser in accordance with the present invention.
Figure 2:
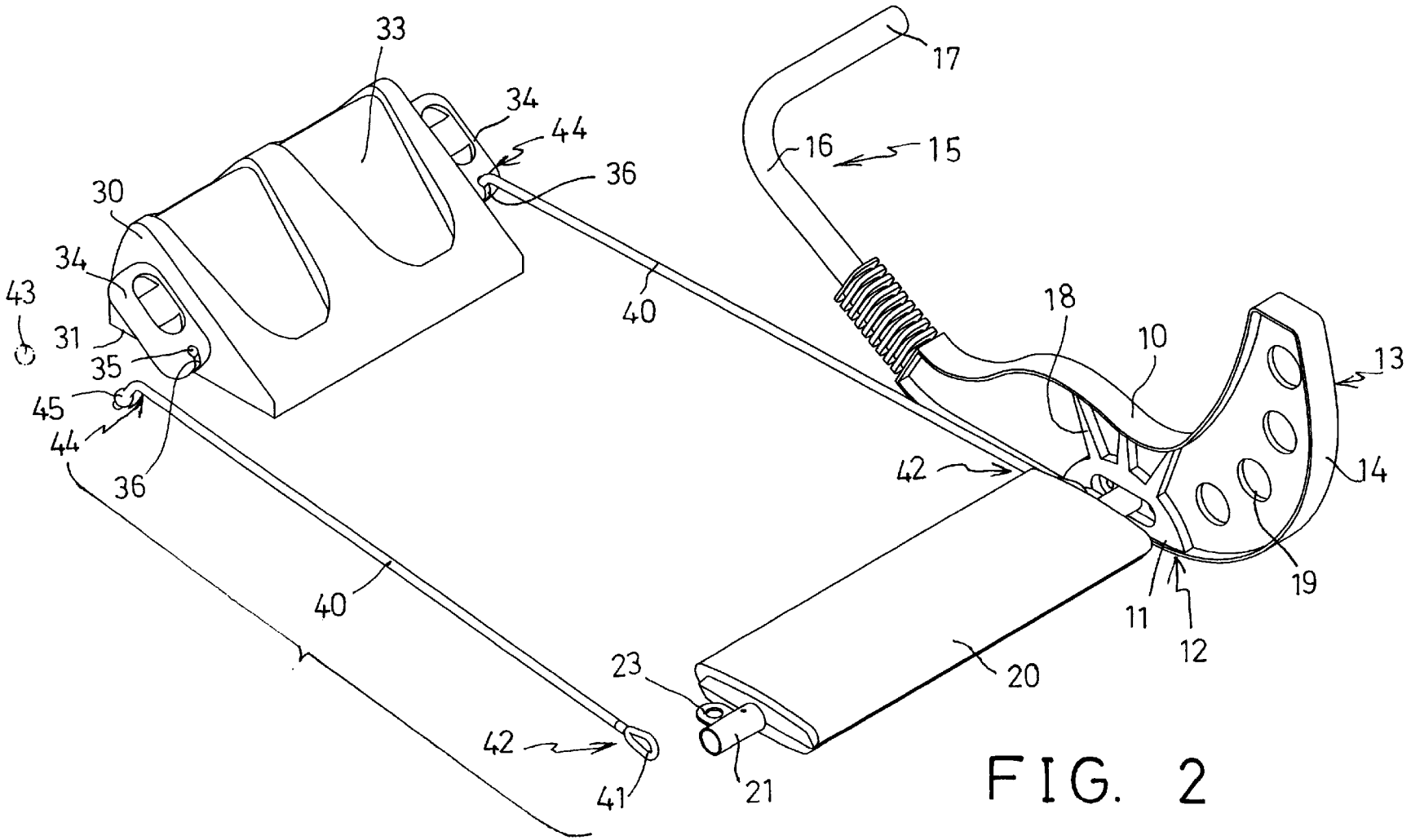
FIG. 2 is a partial exploded view of the exerciser.
Figure 3:
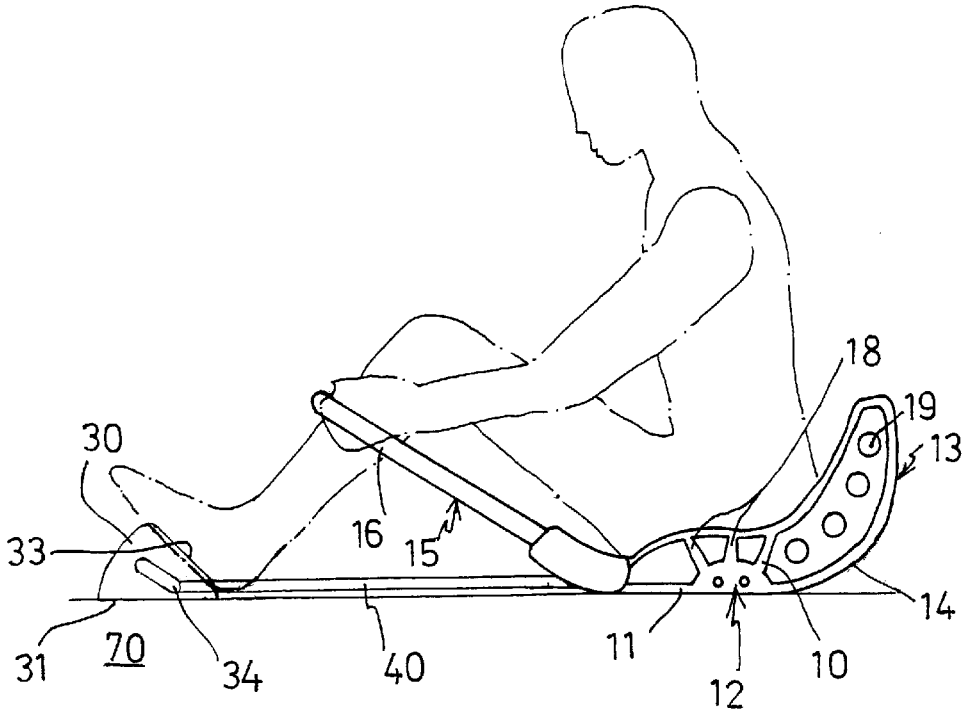
FIG. 3 is a side elevational view of the exerciser.

Referring to the drawings, and initially to FIGS. 1–3, an exerciser in accordance with the present invention comprises a pair of frames 10 each including a flat bottom surface 11 formed in the intermediate or middle portion 12 thereof, for being stably supported on ground or supporting surfaces 70 (FIG. 3), and each including a rear portion 13 having a curved surface 14 formed thereon for engaging with the supporting surface 70 while conducting a swinging operation relative to the supporting surface 70.

A seat 20 is pivotally or rotatably secured between the frames 10 with a pivot rod 21. For example, the pivot rod 21 has two ends rotatably secured to the frames 10 respectively, and the seat 20 is rotatably engaged onto the pivot rod 21, for allowing the seat 20 to be rotated or pivotal relative to the frames 10, and for allowing the seat 20 to stably support the user while the frames 10 are swinging relative to the supporting surface 70.

The frames 10 each includes a front portion 15 having a handle 16 extended therefrom or provided thereon for being grasped by the user. It is preferable that the handles 16 each includes a hand grip 17 laterally extended outwardly therefrom or extended away from each other, for allowing the user to easily grasp the hand grips 17. The users may pull the hand grip 17 to rotate or to swing the frames 10, in order to elevate the seat 20 and their own bodies against the weight of the users.

As shown in the drawings, the frames 10 may be formed by molding processes, or mold injection processes, and may be manufactured by plastic, metal, composite, synthetic, or other materials, such that the frame 10 may be quickly manufactured with mass production processes. The frames 10 may include one or more reinforcing ribs 18 formed or provided therein, and one or more weight reducing orifices 19 formed therein.

A foot rest 30 may further be provided, and includes a flat bottom surface 31 for being stably or slidably supported on the supporting surface 70, and includes an inclined surface 33 formed in the upper portion thereof and facing toward the user, for allowing the user to stably step onto the foot rest 30. The foot rest 30 may further include two brackets 34 extended laterally and outwardly from two sides thereof respectively.

For example, the brackets 34 each includes an aperture 35 and a slit 36 formed therein and communicating with each other. One or more, such as two resilient members 40 may further be provided and coupled between the frames 10 and/or the seat 20 and the foot rest 30, for resiliently coupling the foot rest 30 to the frames 10 and/or the seat 20, and for allowing the foot rest 30 to be moved away from the seat 20 against the spring biasing forces of the resilient members 40.

For example, the pivot rod 21 includes two ends each having a loop or a ring 23 provided thereon (FIG. 2), the resilient members 40 may be the resilient and tubular rubber members 40 each having a ring or a loop 41 formed and provided on one end 42 thereof for coupling to the ring 23 of the pivot rod 21, and thus for coupling the resilient members 40 to the seat 20 or to the pivot rod 21.

The resilient members 40 may be engaged into the apertures 35 of the brackets 34 of the foot rest 30, and each may include a ball member 43 engaged in the other end 44 thereof, for forming an enlarged element 45 on the other end 44 thereof (FIG. 2). The enlarged element 45 may anchor to the bracket 34 of the foot rest 30, in order to secure or couple the other ends 44 of the resilient members 40 to the foot rest 30.

Figure 4:
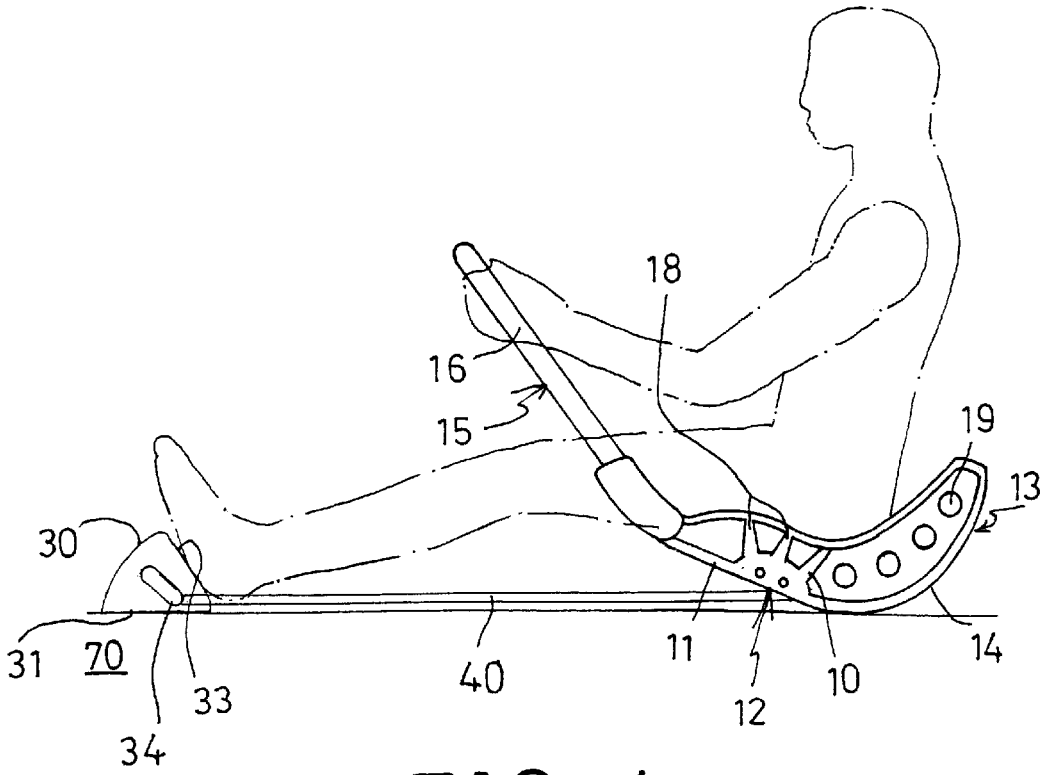
FIG. 4 is a side elevational view similar to FIG. 3, illustrating the operation of the exerciser.

In operation, as shown in FIGS. 3 and 4, the users may pull the hand grip 17 to rotate or to swing the frames 10, in order to elevate the seat 20 and their own bodies against the weight of the users, by swingingly engaging the surfaces 11, 14 of the frames 10 with the supporting surface 70.

In addition, the users may move the foot rest 30 away from the frames 10 and/or the seat 20, against the spring biasing forces of the resilient members 40, such that the users may also exercise their lower muscle groups.

Furthermore, when the users step onto the foot rest 30, the users may feel more comfortable or feel safely to rotate or to swing the frames 10.

Accordingly, the exerciser in accordance with the present invention may be used for conducting at least rowing and stepping exercises, and includes a seat for supporting users, and for allowing users to elevate their own bodies whiling rowing the exerciser, and may further include a foot rest for supporting and/or for exercising foot portion of users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a pair of frames each including a curved bottom surface for engaging with a supporting surface, and for conducting swinging operations, a seat secured between said frames for supporting a user thereon, said frames each including a first end having a handle provided thereon for swinging said frames, to elevate said seat against the user, and each including a second end having said curved bottom surface formed thereon, and each including a middle portion having a flat surface formed thereon, a foot rest, and means for coupling said foot rest to said frames.

2. The exerciser as claimed in claim 1, wherein said coupling means includes at least one resilient member coupled between said foot rest and said frames.

3. The exerciser as claimed in claim 1, wherein said seat includes a pivot rod secured between said frames.

4. An exerciser comprising:

a pair of frames each including a curved bottom surface for engaging with a supporting surface, and for conducting swinging operations, a seat secured between said frames for supporting a user thereon, said seat including a pivot rod secured between said frames, said frames each including a first end having a handle provided thereon for swinging said frames, to elevate said seat against the user, a foot rest, and means for coupling said foot rest to said frames, said coupling means including at least one resilient member coupled between said foot rest and said pivot rod.

5. An exerciser comprising:

a pair of frames each including a curved bottom surface for engaging with a supporting surface, and for conducting swinging operations, a seat secured between said frames for supporting a user thereon, said frames each including a first end having a handle provided thereon for swinging said frames, to elevate said seat against the user, said handles of said frames each including a hand grip laterally extended outwardly therefrom, a foot rest, and means for coupling said foot rest to said frames.

6. The exerciser as claimed in claim 1, wherein said foot rest includes an upper portion having an inclined surface formed thereon to support feet of the user.

7. An exerciser comprising:

a pair of frames each including a curved bottom surface for engaging with a supporting surface, and for conducting swinging operations, a seat secured between said frames for supporting a user thereon, said frames each including a first end having a handle provided thereon for swinging said frames, to elevate said seat against the user, a foot rest including two sides each having a bracket provided thereon, and means for coupling said foot rest to said frames, said coupling means including two resilient members coupled between said brackets and said frames.

8. The exerciser as claimed in claim 7, wherein said brackets each includes an aperture formed therein, said resilient members each includes an enlarged end anchored to said brackets respectively.

9. The exerciser as claimed in claim 8, wherein said brackets each includes a slit formed therein and communicating with said aperture thereof.

* * * * *